US011049400B2

(12) United States Patent
Garrett et al.

(10) Patent No.: US 11,049,400 B2
(45) **Date of Patent: *Jun. 29, 2021**

(54) AUTONOMOUS INTERSECTION WARNING SYSTEM FOR CONNECTED VEHICLES

(71) Applicant: WHELEN ENGINEERING COMPANY, INC., Chester, CT (US)

(72) Inventors: Caleb Garrett, Essex, CT (US); Joseph Ali Eduardo, Middletown, CT (US)

(73) Assignee: WHELEN ENGINEERING COMPANY, INC., Chester, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/812,484

(22) Filed: Mar. 9, 2020

(65) Prior Publication Data

US 2020/0211397 A1 Jul. 2, 2020

Related U.S. Application Data

(63) Continuation of application No. 16/007,518, filed on Jun. 13, 2018, now Pat. No. 10,657,821.

(51) Int. Cl.
*G08G 1/16* (2006.01)

(52) U.S. Cl.
CPC ..... *G08G 1/166* (2013.01); *G08G 1/164* (2013.01)

(58) Field of Classification Search
CPC ..... G08G 1/00; G08G 1/0125; G08G 1/0129; G08G 1/017; G08G 1/065; G08G 1/16;
(Continued)

(56) References Cited

U.S. PATENT DOCUMENTS 4,704,610 A 11/1987 Smith et al.
6,028,514 A 2/2000 Lemelson et al.
(Continued)

FOREIGN PATENT DOCUMENTS

CA 2215440 A1 3/1999
CN 104112348 A 10/2014
(Continued)

OTHER PUBLICATIONS

Anzilotti, E., Can The Private Sector Help Cities Stop Traffic Deaths?, www.fastcompany.com, World Changing Ideas Newsletter, Jan. 2, 2018.

(Continued)

*Primary Examiner* — Brian Wilson
(74) *Attorney, Agent, or Firm* — Dilworth IP, LLC

(57) ABSTRACT

A warning system for use on a first vehicle includes a warning device connected to a control assembly. The control assembly includes a controller, a processor, a memory and a power supply. A GPS receiver is connected to the control assembly for determining the geographic location of the vehicle and for acquiring a local map of the vicinity of the vehicle. The control assembly also includes an intersection detection system for identifying a target intersection being approached by the vehicle and is configured to determine whether the vehicle is in the proximity of the target intersection. The control assembly also is configured to activate the warning system to issue a warning when the vehicle is within the predetermined proximity of a target intersection.

7 Claims, 5 Drawing Sheets

(58) Field of Classification Search
CPC ..... G08G 1/164; G08G 1/166; G08G 1/12; G08G 1/205
USPC ..... 340/901–932.1, 988–996, 435, 436, 463, 340/464, 468, 471, 472, 573.1, 576
See application file for complete search history.

(56) References Cited

U.S. PATENT DOCUMENTS 6,112,075 A 8/2000 Weiser
6,516,273 B1 2/2003 Pierowicz et al.
6,700,504 B1 3/2004 Aslandogan et al.
6,895,332 B2 5/2005 King et al.
6,958,707 B1 10/2005 Siegel
7,046,160 B2 5/2006 Pederson et al.
7,085,637 B2 8/2006 Breed et al.
7,271,736 B2 9/2007 Siegel et al.
7,283,045 B1 10/2007 Manz
7,480,514 B2 1/2009 Karaoguz et al.
7,522,998 B2 4/2009 Hughes
7,663,504 B2 2/2010 Votaw et al.
7,868,783 B2 1/2011 Bachelder
7,884,738 B2 2/2011 Pappas et al.
7,899,621 B2 3/2011 Breed et al.
8,094,040 B1 1/2012 Cornett et al.
8,346,468 B2 1/2013 Emanuel et al.
8,350,721 B2 1/2013 Carr
8,487,780 B2 7/2013 Edwardson
8,552,885 B2 10/2013 Rijks
8,581,744 B2 11/2013 Myler
8,593,301 B2 11/2013 Newman
8,624,727 B2 1/2014 Saigh et al.
8,712,429 B2 4/2014 Nagorniak
8,723,680 B1 5/2014 Baker
8,823,548 B2 9/2014 Johnson et al.
8,842,021 B2 9/2014 Behm et al.
8,928,492 B2 1/2015 Boscacci
8,935,036 B1 * 1/2015 Christensen ..... G08G 1/096741 701/29.1
8,963,705 B2 2/2015 Miller et al.
9,053,637 B2 6/2015 Mawbey et al.
9,254,781 B2 2/2016 Applebaum
9,278,689 B1 3/2016 Delp
9,412,273 B2 8/2016 Ricci
9,547,986 B1 1/2017 Curlander et al.
9,635,500 B1 4/2017 Becker et al.
9,738,217 B1 8/2017 Bradley et al.
9,742,709 B1 8/2017 Laich
9,756,668 B2 9/2017 Farrell et al.
9,762,470 B2 9/2017 Alam et al.
9,786,154 B1 10/2017 Potter et al.
9,805,430 B2 10/2017 Miasnik et al.
9,805,601 B1 10/2017 Fields et al.
9,843,913 B2 12/2017 Dahan et al.
9,894,478 B1 2/2018 DeLuca et al.
10,127,813 B2 11/2018 Walsh et al.
10,531,224 B1 1/2020 Lemieux
10,559,208 B1 2/2020 McAlpine et al.
10,689,815 B2 6/2020 Sheckler et al.
2003/0137415 A1 7/2003 Thomson
2003/0141990 A1 7/2003 Coon
2003/0169181 A1 9/2003 Taylor
2004/0246144 A1 12/2004 Siegel et al.
2004/0263355 A1 12/2004 Carroll
2005/0104745 A1 5/2005 Bachelder et al.
2006/0009234 A1 1/2006 Freer
2006/0030984 A1 2/2006 Kamiya
2007/0132608 A1 6/2007 Votaw et al.
2007/0132609 A1 6/2007 Stackelhouse
2007/0159354 A1 7/2007 Rosenberg
2008/0088434 A1 4/2008 Frieder et al.
2008/0125970 A1 5/2008 Scheckler
2009/0299625 A1 12/2009 Denaro
2011/0018736 A1 1/2011 Carr
2011/0068949 A1 3/2011 Ieda et al.
2011/0178811 A1 7/2011 Sheridan
2011/0187559 A1 * 8/2011 Applebaum ..... B60Q 1/00 340/907
2011/0256881 A1 10/2011 Huang et al.
2012/0259537 A1 10/2012 Schmidt et al.
2012/0313792 A1 12/2012 Behm et al.
2013/0027221 A1 1/2013 Johnson et al.
2013/0090843 A1 4/2013 Funabashi
2013/0105583 A1 5/2013 Peterson et al.
2013/0110292 A1 5/2013 Peterson et al.
2013/0110357 A1 5/2013 Peterson et al.
2013/0173474 A1 7/2013 Ranganathan et al.
2013/0295970 A1 11/2013 Sheshadri et al.
2013/0326137 A1 12/2013 Bilange et al.
2014/0121932 A1 5/2014 Zeng
2014/0210643 A1 7/2014 Baker
2014/0354449 A1 12/2014 Alam et al.
2015/0288819 A1 10/2015 Brown et al.
2016/0042767 A1 2/2016 Araya et al.
2016/0063773 A1 3/2016 Hatton et al.
2016/0071412 A1 3/2016 Bullock et al.
2016/0071417 A1 3/2016 Lewis et al.
2016/0100302 A1 4/2016 Barash et al.
2016/0154117 A1 6/2016 Baudia
2016/0171521 A1 6/2016 Ramirez et al.
2016/0210858 A1 7/2016 Foster et al.
2017/0015239 A1 1/2017 Rao et al.
2017/0098372 A1 4/2017 Eilertsen
2017/0098373 A1 4/2017 Filley et al.
2017/0105108 A1 4/2017 South
2017/0187787 A1 6/2017 Syamala et al.
2017/0192429 A1 7/2017 Tseng et al.
2017/0193821 A1 7/2017 Baranga et al.
2017/0219360 A1 8/2017 Cui et al.
2017/0241660 A1 8/2017 Sekar et al.
2017/0332347 A1 11/2017 Boss et al.
2017/0353892 A1 12/2017 Elia et al.
2017/0359712 A1 12/2017 Meredith et al.
2017/0366930 A1 12/2017 Treman
2018/0005523 A1 1/2018 Cahan et al.
2018/0059669 A1 3/2018 Madigan et al.
2018/0087914 A1 3/2018 Bravo et al.
2018/0090000 A1 3/2018 Bravo et al.
2018/0121956 A1 5/2018 DeLuca et al.
2018/0204447 A1 7/2018 Morgan et al.
2018/0232767 A1 8/2018 Garg et al.
2018/0322785 A1 11/2018 Jerichow et al.
2019/0019297 A1 1/2019 Lim et al.
2019/0027032 A1 1/2019 Arunachalam
2019/0035269 A1 1/2019 Donovan et al.
2019/0082377 A1 3/2019 Silver
2019/0088106 A1 3/2019 Grundstrom
2019/0088140 A1 3/2019 Sheckler et al.
2019/0101930 A1 4/2019 Yadmellat
2019/0220001 A1 7/2019 Lavoie et al.

FOREIGN PATENT DOCUMENTS

CN 105857277 A 8/2016
CN 105894857 A 8/2016
DE 102013008545 A1 * 11/2014 ..... B60Q 5/005
DE 102013008545 A1 11/2014
DE 102016005114 A1 * 2/2017 ..... B60Q 5/00
DE 102016005114 A1 2/2017
EP 2325822 A1 5/2011
FR 3046771 A1 7/2017
JP 2009198391 A 9/2009
JP 2014201181 A 10/2014
KR 20160092965 A 8/2016
WO 2006034246 A2 3/2006
WO 2015136958 A1 9/2015
WO 2017082756 A1 5/2017
WO 2017200754 A1 5/2017
WO 2017200794 A1 11/2017

OTHER PUBLICATIONS

2018 GovTech 100, Next Wave of Civic Innovation, http://www.govtech.com/100/, Jan. 22, 2018.

(56) References Cited

OTHER PUBLICATIONS

Haas AlertR2V™ (Responder-to-Vehicle) Technology: Enabling Safer, Faster, Emergency Response, HAAS Inc., 2018.
PCT International Search Report and Written Opinion dated Aug. 27, 2018 from corresponding Application No. PCT/US18/37297, 17 pages.
International Search Report and Written Opinion; Application No. PCT/US2019/012817; dated Oct. 9, 2019.
PCT International Search Report and Written Opinion of the International Searching Authority dated Oct. 8, 2019 in corresponding Application No. PCT/US2019/021604, 15 pages.
International Search Report and Written Opinion issued in PCT/US2018/063210 dated Mar. 7, 2019.

* cited by examiner

AUTONOMOUS INTERSECTION WARNING SYSTEM FOR CONNECTED VEHICLES

FIELD OF THE INVENTION

The present disclosure relates generally to a method and apparatus for providing an alert for the approach of a vehicle to an intersection so that pedestrians and other vehicle operators can yield to passage of the approaching vehicle, and in particular to providing an alert for the approach of an emergency response vehicle.

BACKGROUND

The urgency for emergency vehicles to reach the location where first responders are needed imposes a need to drive at higher-than-normal speeds and to claim a right of way relative to other vehicles and pedestrians at unpredictable times and under circumstances when conventional rules of the road would favor the other vehicles or pedestrians. Emergency vehicles (police, fire, ambulance, etc.) are therefore equipped with approach warning systems to alert those in the vicinity of the vehicle that they should yield the right of way to the emergency vehicle. Yielding clears a roadway so that the emergency vehicle can pass without delay and without injury to those on the roadway between the emergency vehicle and its destination. The approach warning systems conventionally include sirens and/or lights, which are typically provided as a "light bar" mounted on the roof of a vehicle. A light bar is typically capable of generating a variety of patterns of lights and siren sounds to communicate the degree of urgency with which the vehicle is approaching.

RELATED ART

U.S. Pat. No. 9,738,217 to Bradley et al., dated Aug. 22, 2017 and entitled "Modular Vehicle Light" discloses a representative prior art warning system.

U.S. Pat. No. 7,480,514 to Karaoguz et al., dated Jan. 20, 2009 and entitled "GPS Enabled Cell phone with Compass Mode Mapping Function," discloses a method and apparatus for selecting, downloading and displaying a map segment on a wireless terminal.

SUMMARY OF THE INVENTION

The present invention resides in one aspect in a warning system for use on a first vehicle. The warning system includes a warning device on the vehicle for generating a warning; a control assembly for activating the warning device, the control assembly comprising a controller, a processor, a memory and a power supply; and a GPS receiver on the vehicle for determining the geographic location of the vehicle. There is a server in communication with the control assembly and the GPS receiver. The server is configured to access a map file which includes the location of the vehicle and comprising an intersection detection system for identifying a target intersection being approached by the vehicle. The server comprises memory which stores a proximity parameter; and the server is configured to determine the distance between the vehicle and the target intersection, access the proximity parameter, and compare the vehicle distance to the proximity parameter to determine whether the vehicle is in the proximity of the target intersection and if so, to send an intersection warning trigger signal to the control assembly to activate the warning device.

In one embodiment, the proximity parameter is a predetermined proximity distance value for comparison to the distance of a vehicle to a target intersection, and the server is configured to determine the distance of the vehicle to the target intersection and to compare the vehicle-to-intersection distance to the predetermined proximity distance to determine whether the vehicle is within the proximity of the target intersection.

In another embodiment the proximity parameter is a predetermined time-to-intersection arrival value and wherein the server is configured to determine an estimated time of arrival (ETA) of the vehicle to the target intersection and to compare the ETA to the predetermined time-to-intersection arrival value to determine whether the vehicle is within the proximity of the target intersection.

In an alternative embodiment the server is configured to create a map subfile by selecting a portion of the map file corresponding to a target intersection and the immediately subsequent intersections on each road on which the vehicle may exit the target intersection, and to send the map subfile to the GPS receiver.

According to another aspect there is disclosed a warning system for use on a vehicle. The warning system comprises a warning device connected to a control assembly comprising a controller, a processor, a memory and a power supply; and a GPS receiver connected to the control assembly for determining the geographic location of the vehicle and for acquiring a local map of the vicinity of the vehicle. The control assembly comprises a map file and includes an intersection detection system for identifying a target intersection being approached by the vehicle; and the control assembly includes an proximity parameter stored in memory and is configured to use the proximity parameter to determine whether the vehicle is in the proximity of the target intersection and if so, to activate the warning device.

In another embodiment the proximity parameter is a stored predetermined time-to-intersection arrival value and wherein the server is configured to determine an estimated time of arrival (ETA) of the vehicle to the target intersection and to compare the ETA to the predetermined time-to-intersection arrival value to determine whether the vehicle is within the proximity of the target intersection.

Optionally, the map file is a graph file and the subfile comprises graph data including the vertex for the first target intersection and neighboring vertices. In another optional aspect, the system is configured to use the vehicle position data from the GPS receiver to create a temporary vehicle position vertex to represent the position of the vehicle, and to generate a distance attribute relating the temporary vehicle vertex to the first target intersection vertex, and to compare the distance attribute to the predetermined proximity parameter to determine whether the vehicle is in the proximity of the first target intersection.

Optionally, the warning system is configured to limit the subfile to data for locations that the vehicle is projected to reach within a predetermined time, e.g., within thirty seconds.

According to yet another aspect there is disclosed a process for the operation of a vehicle warning system. The process comprises acquiring a GPS signal from a GPS receiver on the vehicle to identify the location of the vehicle; acquiring a map of the vicinity of the vehicle; identifying a target intersection on the map; storing a proximity parameter; and determining whether the vehicle is within a predetermined proximity of the target intersection and if so, activating a warning device.

In a particular embodiment of the process the proximity parameter is a proximity distance and the process comprises determining the distance of the vehicle from the target intersection and comparing the vehicle distance to a predetermined proximity distance.

In another embodiment, the proximity parameter is a time-to-intersection arrival value and the process comprises determining the estimated time of arrival (ETA) of the vehicle to the target intersection and comparing the ETA to the predetermined proximity time-to-arrival.

One particular embodiment of the process comprises acquiring a map in the form of a graph data file; identifying a first target intersection vertex representing the target intersection; storing a proximity parameter; creating a temporary vehicle position vertex on an edge in the graph data file to represent the position of the vehicle; generating a distance attribute relating the temporary vehicle vertex to the first target intersection vertex; and comparing the distance attribute to the predetermined proximity parameter to determine whether the vehicle is in the proximity of the first target intersection.

In yet another aspect there is a collision avoidance system comprising a server and a plurality of vehicles in communication with the server. Each vehicle is equipped to emit time-stamped location signals to the server; and the server is configured to compare a first time-stamped location signal from a first vehicle and a second time-stamped location signal from a second vehicle, and acquire a roadmap including the locations of at least the first vehicle and the second vehicle, and to identify a first target intersection for the first vehicle and a second target intersection for the second vehicle, and determine a first estimated time of arrival for the first vehicle to the first target intersection and a second estimated time of arrival for the second vehicle to the second target intersection, and to determine whether the first target intersection is the same as the second target intersection and, if so, whether the first estimated time of arrival falls within a predetermined timeframe relative to the second estimated time of arrival and if so, issue an imminent collision warning to the first vehicle and the second vehicle.

DETAILED DESCRIPTION

Figure 1:
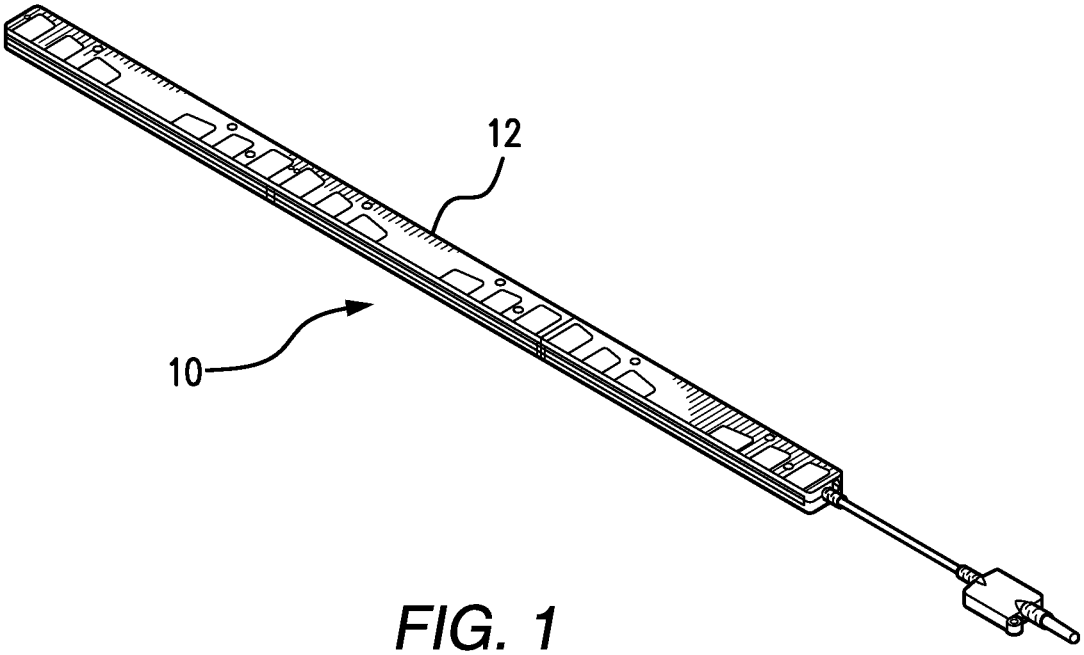
FIG. 1 is a perspective schematic view of a lightbar and controller for use in one embodiment of the present invention.

The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure.

Emergency vehicles (police cars, firetrucks, ambulances, etc.) are normally equipped with passive warning systems that comprise warning devices (e.g., lights and/or sirens) which emit warnings (e.g., flashes of light, siren sounds, etc.) and associated electronic control assemblies (typically comprising a processor, a memory, a power supply and a controller). The vehicle operators manually operate the controller to activate the warning device to alert other vehicle drivers and nearby pedestrians (in general, 'civilians') of the approach of the emergency vehicle and the need for civilians to get safely out of the way of the emergency vehicle. Where a warning device is described herein as lights (i.e., emergency vehicle lights), this is not intended as a limitation on the invention and one of ordinary skill in the art should understand that other warning devices (e.g., a siren) can be implemented instead of, or in addition to, lights, and the term "warning" is intended to encompass the output of any warning device.

When responding to emergencies, it is common for emergency vehicles to traverse an intersection without coming to a stop. Therefore, the approach of an emergency vehicle to a roadway intersection can pose more potential for injury to others than on one-way traffic lanes, making use of a warning device, e.g., lights and/or sirens, very important.

Some intersections are equipped with a traffic control system (typically featuring conventional three-color traffic lights and, often but not always, electric pedestrian "WALK/DON'T WALK" signs) to control and promote the orderly flow of routine vehicle and pedestrian traffic through the intersection, but emergency vehicles often traverse such intersections even against the 'Stop' or 'Go' right of way indicated by a traffic signal situated at the intersection. Systems exist to reduce the hazards at such intersections by enabling traffic control system to react to the approach of an emergency vehicle, to signal civilian traffic to stop and clear the intersection. In still other places, emergency vehicles do not have any direct or indirect control over traffic signals that would allow them to reach their destination in a safe and timely manner. Other systems exist for use in civilian vehicles to alert the drivers to the approach of an emergency vehicle.

In all of these scenarios, safety would be enhanced if the operator of the emergency vehicle activates a warning device to emit a warning upon approach to the intersection. In this context the warning is an "intersection approach warning." However, even as an emergency vehicle approaches an intersection, the operator may be pre-occupied by the need to communicate with a dispatcher or with other responders to obtain information about the emergency, or by a need to navigate around hazards in the road, and these distractions may prevent the operator from activating a passive warning system in a timely and effective way. Moreover, prior art passive warning systems do not alert the driver of the emergency vehicle to the approach of another emergency vehicle to the same intersection, so collisions between emergency vehicles are a serious concern. Therefore, there is now recognized a need for a warning system for emergency vehicles to automatically activate warning devices when the emergency vehicle approaches an intersection, rather than relying on a vehicle operator to do so manually. By reducing operator involvement in the operation of the vehicle's warning device(s), the operator(s) can direct focus on other aspects of vehicle operation (e.g., pay attention to road conditions, pedestrians, etc.) while still enhancing safety of nearby pedestrians and vehicle operators by issuing an appropriate warning.

Systems and methods are disclosed herein by which safety in emergency vehicle intersection traversal scenarios is improved. In some embodiments, an emergency vehicle is equipped with a warning system configured to autonomously initiate an intersection approach warning when the vehicle is in the proximity of an intersection, thereby improving safety even when the attention of the operator(s) of the emergency vehicle is on other aspects of vehicle operation or on other concerns. Being within proximity of an intersection means that the vehicle is within a specified proximity parameter, i.e., within a specified distance or is expected to arrive within a specified time. Optionally, the intersection approach warning differs from the warning made by the warning device remotely from the intersection (i.e., not in the vicinity of the intersection). Being in the proximity or vicinity of an intersection can mean that the vehicle is within a predetermined distance from the intersection, or that the vehicle is projected to arrive at the intersection within a predetermined time. The proximity parameter should be chosen to give sufficient warning to civilians within the intersection without activating early such that it may be confusing. Around the time that vehicle leaves the intersection, the intersection warning may be deactivated, and the system resumes pre-intersection operation.

In another embodiment, a system disclosed utilizes the latitude, longitude and heading of the vehicle as provided by a GPS (Global Positioning System) receiver, and the latitude and longitude of nearby intersections acquired from a digital map file to determine which intersection the vehicle is approaching (the "target intersection"). A GPS receiver may provide this information, but a magnetometer may also be used as an accuracy supplement to the GPS receiver. This is the minimum information required for this embodiment. Thus, the system can operate as an intersection detection system.

The latitude and longitude of each intersection and a variety of other information may be acquired from a variety of public and commercial map data sources, e.g., OpenStreetMap data. The system may be configured to acquire the raw map data and to extract, via reverse geocoding, the intersection locations and other selected information such as the presence of a traffic signal, the directions of traffic through the intersection, or the speed limit of the roads feeding into the intersection. Alternatively, this information can be provided manually by a vehicle operator, using a user interface.

The warning system may have memory in which map data is stored for access, or the system may be configured to access online mapping data. Services with an Application Programming Interface such as Google Maps or Bing Maps could provide mapping data and cross street information. Accessing online data may increase cost and potentially increase latency but has the benefit of always having up-to-date mapping information.

One optional aspect relates to a server-side improvement to the intersection discovery system in which a system with additional street map data can increase the performance of an intersection detection system. In such an embodiment, the entire road network is implemented in a graph data structure and stored in a geographically indexed database. All road intersection points on the map are represented as vertices, and all streets are represented as edges. Vertices are strung together with edges which represent streets. When a vertex has three or more edges, that vertex represents an intersection. In one embodiment, the map file is a graph data file and the system is configured to use the vehicle position data from the GPS receiver to create a temporary vehicle position vertex on an edge in the graph data to represent the position of the vehicle, and to generate a distance attribute relating the temporary vehicle vertex to the first target intersection vertex, and to compare the distance attribute to the predetermined proximity parameter to determine whether the vehicle is in the proximity of the first target intersection.

In one embodiment the warning system is configured to excise map data for the area around the vehicle to create a smaller file to send to the vehicle control assembly, to reduce processing problems resulting from the latency of cellular networks and the time critical nature of the intersection warning functionality. These intersections are found by the server and transmitted to the control assembly, which then only needs to store a small amount of data that is refreshed periodically as the vehicle's location (specifically, the location of the warning system, when mounted on the vehicle) changes. The intersections may be selected in relation to the vehicle's current position. the server may be programmed to access the map graph data and use the GPS data to identify a vertex $X_0$ that the vehicle is approaching (a "first target intersection"), and then identify the neighbor vertices $Y_{0,\ 1\text{-}n}$ ("potential second target intersections"), and create a map subfile which includes vertex $X_0$ and vertices $Y_{0,\ 1\text{-}n}$. The subfile may optionally include neighbor vertices Z of the $Y_0$ vertices as well. Once the vehicle traverses the first vertex $X_0$, its choice of path toward a neighbor vertex $Y_{0,x}$ is known and that vertex $Y_{0,x}$ becomes the new first target intersection $X_1$, the other neighbor vertices $Y_0$ may be removed from this buffer to save processing power and memory on the client system and a new set of neighbor vertices $Y_{1,1\text{-}n}$ can be selected. Optionally, the server may be configured to limit the subfile to show vertices and edges that the vehicle is projected to reach within a predetermined time, i.e., to encompass locations that the vehicle might reach from a current location within 10, 15, 20 or 30 seconds, based on current speed. Optionally, the server can be configured to reduce the size of the subfile by deleting from the source map data which is not needed for the proximity detection, e.g., by deleting data identifying "points of interest," public accommodations, etc. The server may be configured to buffer as many iterations as necessary to minimize latency in intersection detection. In other embodiments, the system may take into account the vehicle speed, heading, operating state and time-to-intersection proximity parameter.

With this intersection detection system, intersections may be more intelligently selected and buffered to the control assembly in the vehicle. The street on which a vehicle is located may be inferred by the nearest vertex to the vehicle's location. The direction on the street the vehicle is traveling may also be inferred using the vehicle's heading. Using this information, the server may iteratively parse the street map graph structure to find the first intersection the vehicle is expected to traverse (the first target intersection). For each street connected to this first target intersection, there is an intersection to which the vehicle may travel along a mapped route and traverse next, based on current heading ("potential second target intersections"). The system is therefore configured to select for processing a subset of map data (a "subfile") limited mainly to the first target intersection and the potential second target intersections, i.e., to their respective vertices and edges. The subfile may be sent to the control assembly in the vehicle as part of the upcoming intersection buffer. The server may calculate an estimated time of arrival (ETA) for each locally buffered intersection. When that time falls within the proximity parameter, the server sends an intersection warning trigger signal to the control assembly, which is configured to respond by activating the vehicle's warning device to generate an intersection approach warning. This process is repeated on an ongoing basis during vehicle operation. Optionally, the server may also send a map subfile for use by a GPS or other navigation display in the vehicle. Reliance on the server for these processes reduces the need for electronic memory and computing processing power in the vehicle itself.

Once the vehicle traverses the first target intersection, its choice of path toward a potential second target intersection is known and that potential second target intersection becomes the new first target intersection, the other potential second target intersections may be removed from this buffer to save processing power and memory on the client system and a new set of potential second target intersections can be selected. The server may be configured to buffer as many iterations as necessary to minimize latency in intersection detection.

The foregoing description refers to the use of the server for receiving vehicle location from a GPS receiver, acquiring map data and identifying first target intersections and potential second target intersections therefrom, and also for determining whether the vehicle is in the vicinity of the first target intersection, and if so, the server will send an intersection warning trigger signal to the vehicle control assembly.

In other embodiments, the vehicle warning system may operate substantially without support from a server. In one such embodiment, the vehicle control assembly has sufficient memory and processing power so that it can function by acquiring location data and a map of the vicinity of the vehicle, and it will have stored therein the relevant proximity parameters and will include programming to enable it to identify first target intersections and potential second target intersections in local memory, and to determine whether the vehicle is in the proximity of a first target intersection and, if so, activate the warning device on the vehicle. In another such embodiment, vehicle system is pre-equipped with a stored map of the region in which the vehicle operates so that the intersection data is stored locally in the system. However, for a control assembly having limited memory (e.g., flash memory on the order of megabytes) or having a processor too slow to continuously parse the data to find nearby intersections within acceptable performance parameters, it might not be feasible to store and process data for a large-scale map. To address this problem, a system may optionally utilize a cloud server that stores intersection location data in a geographically indexed database. This database may be polled to find nearby intersections (e.g., first target and potential second target intersections, as described above). Each vehicle may then be equipped by a wireless connection (cellular, wifi, etc.) allowing the system to access the intersection location information but still perform the tasks of determining whether the vehicle is in the proximity of an intersection and, if so, activating the warning device, with reduced need for local memory and processing power.

With reference to the drawings wherein like numeral represent like parts throughout the several figures, a warning system 10, FIG. 1, comprises a modular vehicle light 12 as a warning device for mounting on an emergency vehicle. The modular light assembly 12 is comprised of a linear series of light modules which are mechanically connected and electrically connected in series/daisy-chain fashion for a given vehicle and function. In one preferred embodiment, each module is capable of generating a horizontally oriented, wide angle, vertically collimated band of illumination (the "warning") in selected colors, patterns, phases and intensities that is projected away from the vehicle. The illumination from a modular vehicle light can be used for a warning, perimeter lighting with white light, or vehicle identification "cruise" lights at low power. While warning light signals are typically flashing light signals, illumination and cruise light signals are typically steady "on" patterns.

Figure 2:
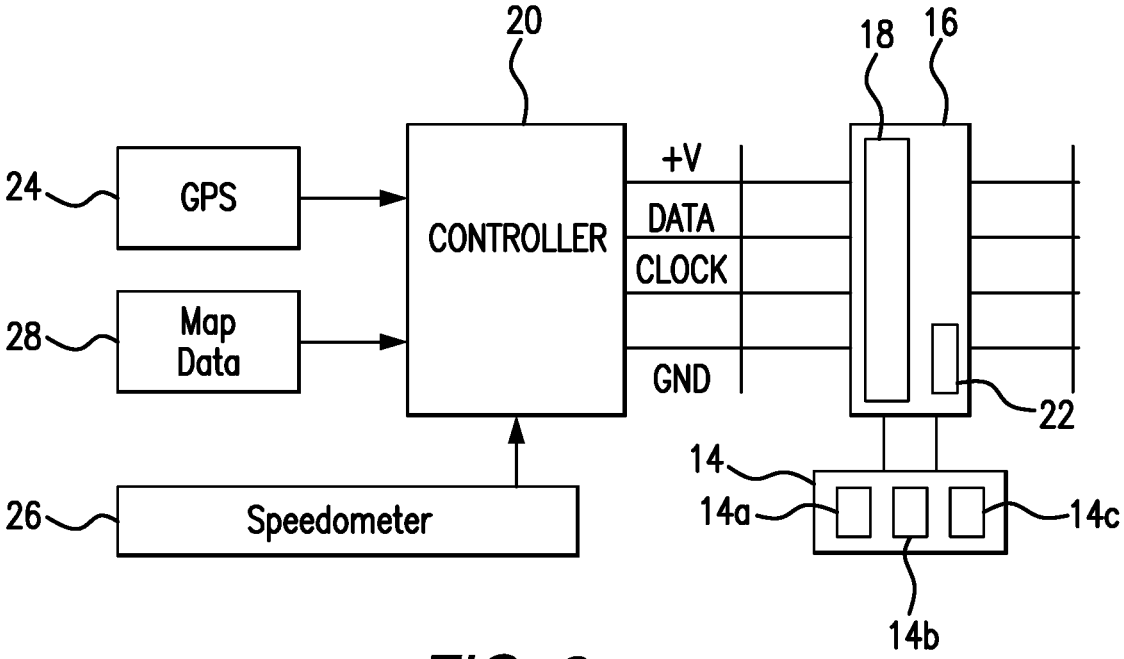
FIG. 2 is a schematic view of the control assembly and a module of the light bar of FIG. 1.

The warning device is connected to a control assembly comprising a controller, a processor, a memory and a power supply. With reference to FIG. 2, a modular warning device comprises an LED assembly 14. The LEDs may be of a single color, two colors or three colors. LEDs for three different frequency emissions (red, yellow and blue) are shown in the illustrated embodiment, indicates as 14*a*, 14*b*, 14*c*, respectively. Other colors and white LEDs may also be employed.

The LEDs are connected to a power supply 16 which includes a communication interface comprising a buffer 18 for receiving instructions from an external controller 20. The power supply 16 has a microprocessor 22 including memory for storing flash patterns. The power supply also carries power transistors arranged as current sources to deliver power to selected LEDs. The power supply is powered from the vehicle's electrical system.

The flash patterns (including non-flash patterns for illumination and cruise functions) themselves and the program necessary to generate the flash pattern reside in the on-board memory of the microprocessor 22. The controller is equipped with a user interface so that the user can manually turn the lights and sirens on or off and, when on, select a desired lighting and/or sound pattern. The control assembly may also comprise an electronic interface (which may be hardware-based (e.g., a USB port)) or signal-based (e.g., Wifi or Bluetooth connection) for entering operating parameters into the memory, such as a desired proximity parameter at which to trigger activation of the warning device.

In one embodiment, the control communicates with a GPS receiver 24. The control assembly is configured to communicate with a server, including sending to the server current location and bearing information for the vehicle, downloading a map subfile sufficient to display the first target intersection and potential second target intersections that the vehicle will approach within a selected radius around the location of the vehicle. The illustrated embodiment includes an optional feature, showing that the control assembly communicates with a speedometer 26 on the vehicle so that vehicle speed can be used as a data input by the system.

Figure 3:
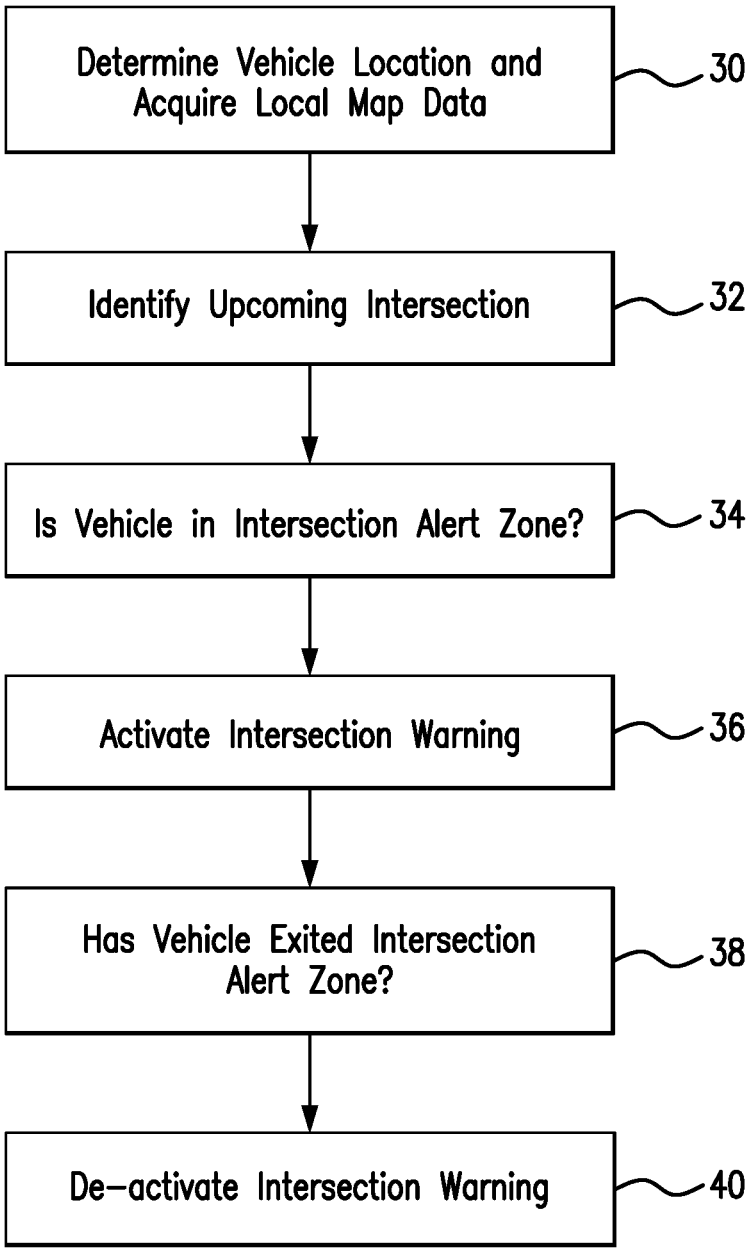
FIG. 3 is a flowchart illustrating one embodiment of a processes to determine if the vehicle is in the vicinity of an intersection and, if so, activating the warning device.
Figure 3A:
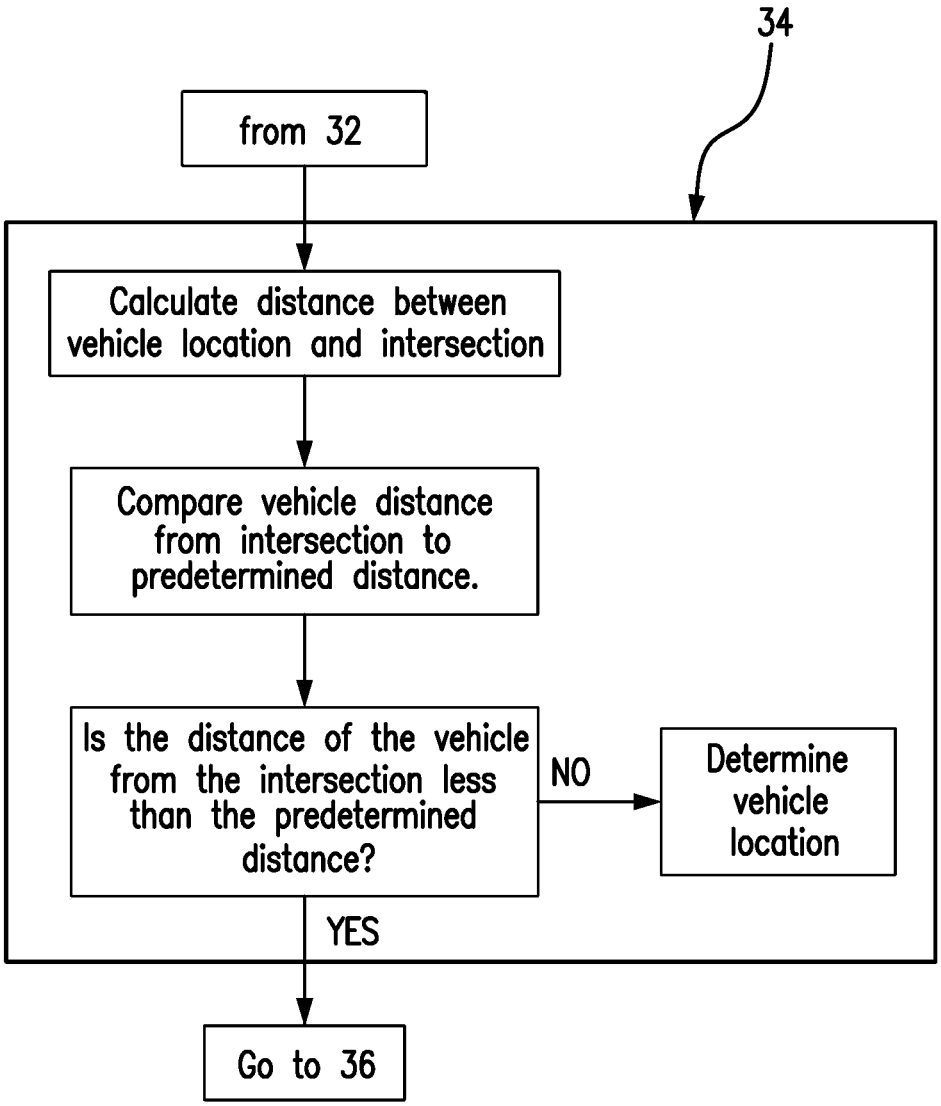
FIG. 3A is a flowchart illustrating a process for determining whether a vehicle is in the vicinity of an intersection.
Figure 3B:
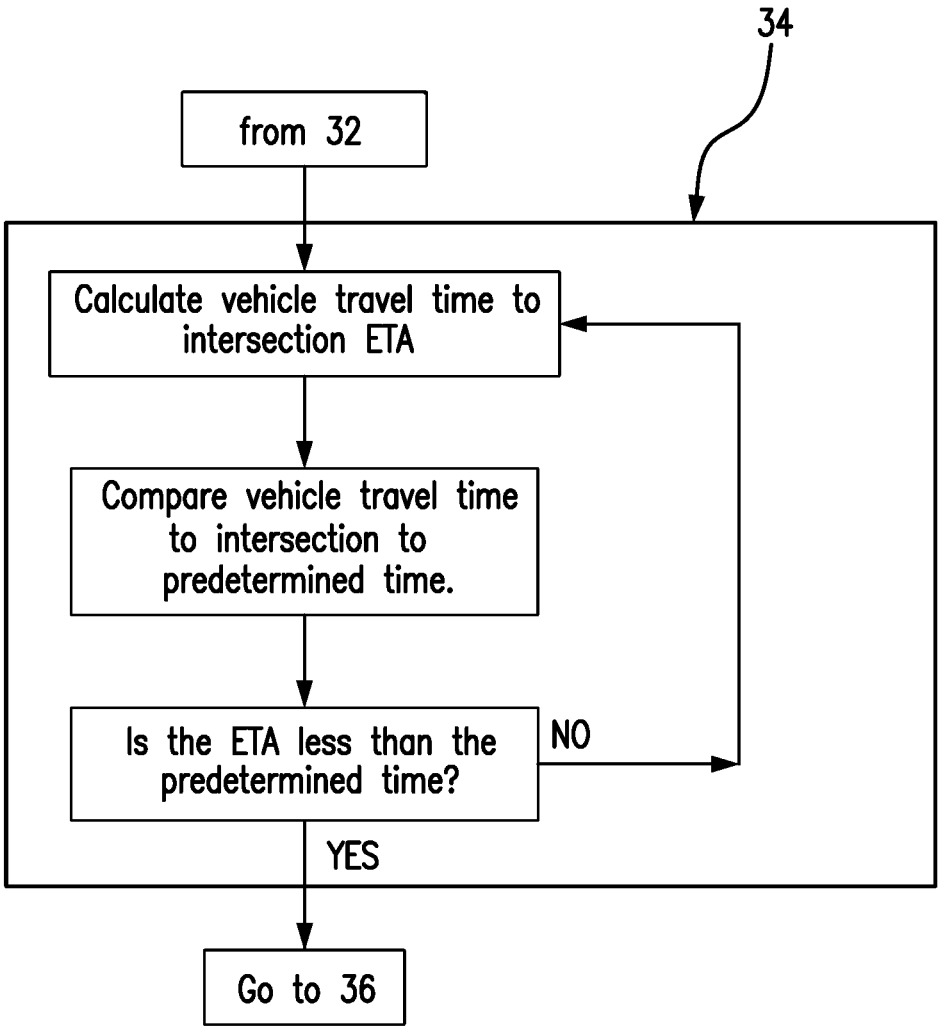
FIG. 3B is a flowchart illustrating another process for determining whether a vehicle is in the vicinity of an intersection.

In one embodiment, the system is configured to determine whether the vehicle is in the proximity of an intersection by receiving the vehicle position and heading from the GPS receiver 24 and accessing a corresponding map 28. For example, as indicated in FIG. 3, the control assembly may send data from the GPS receiver to a server which is configured to access a map of the vicinity of the vehicle (step 30). The server determines which roadway intersection on the map the vehicle appears to be approaching (the "first target intersection) based on the location and heading of the vehicle (step 32) and then whether the vehicle is in the vicinity of the target intersection (step 34). A process for determining whether the vehicle is in the vicinity of the target intersection based on whether the emergency vehicle is within a predetermined distance from the target intersection is illustrated in FIG. 3A; and the process for determining whether the vehicle is in the vicinity of the target intersection based on the expected time of arrival of the emergency vehicle to the target intersection is illustrated in FIG. 3B. If the emergency vehicle is in the vicinity of the target intersection, the system automatically actives the warning lights as an intersection approach warning (step 36). The determination of whether the vehicle is in the vicinity of the intersection is repeated in step 38 (e.g., 5 times per second) to determine whether the emergency vehicle is still in the vicinity of the target intersection (step 38), and if not, the intersection warning is deactivated (step 40). Deactivation of the intersection warning can mean deactivation of the warning device (e.g., turning off the lights and/or silencing the siren) or it can mean reverting the condition of the warning device to what it was prior to the emergency vehicle entering the proximity of the intersection. Therefore, if the emergency vehicle was emitting a first warning (e.g., a first light pattern), entry into the proximity of an intersection may trigger the activation of a second warning pattern (the intersection approach warning), and the system may revert to the first warning when the emergency vehicle leaves the vicinity of the target intersection.

The system can be configured so that upon determining that a vehicle is no longer in the proximity of an intersection, the process is repeated to identify the next target intersection.

In other embodiments, emergency vehicles are equipped to detect the convergence of two or more emergency vehicles upon an intersection and warn the involved emergency vehicle operators to mitigate the incidence of emergency vehicle collisions in intersection traversal scenarios. By warning emergency vehicle operators when another emergency vehicle is converging upon the same intersection, the operator may take action and alter vehicle course and speed accordingly to avoid a collision.

In one embodiment of a collision detection system, a server tracks the location of at least two emergency vehicles, each of which is equipped with a real-time clock and is configured to emit a location signal derived from the GPS receiver and having a timestamp derived from the clock, for receipt by a server, e.g., via a cellular network. The warning system on each vehicle is also configured to receive an imminent collision warning signal from the server and to alert the vehicle operator upon receipt of the imminent collision warning. Optionally, the GPS receiver may be used to retrieve an accurate UTC time that may be used to set the real-time clock peripheral of the host control assembly. Alternatively, an NTP time server may be used to set the real-time clock with slightly less accuracy.

Figure 4:
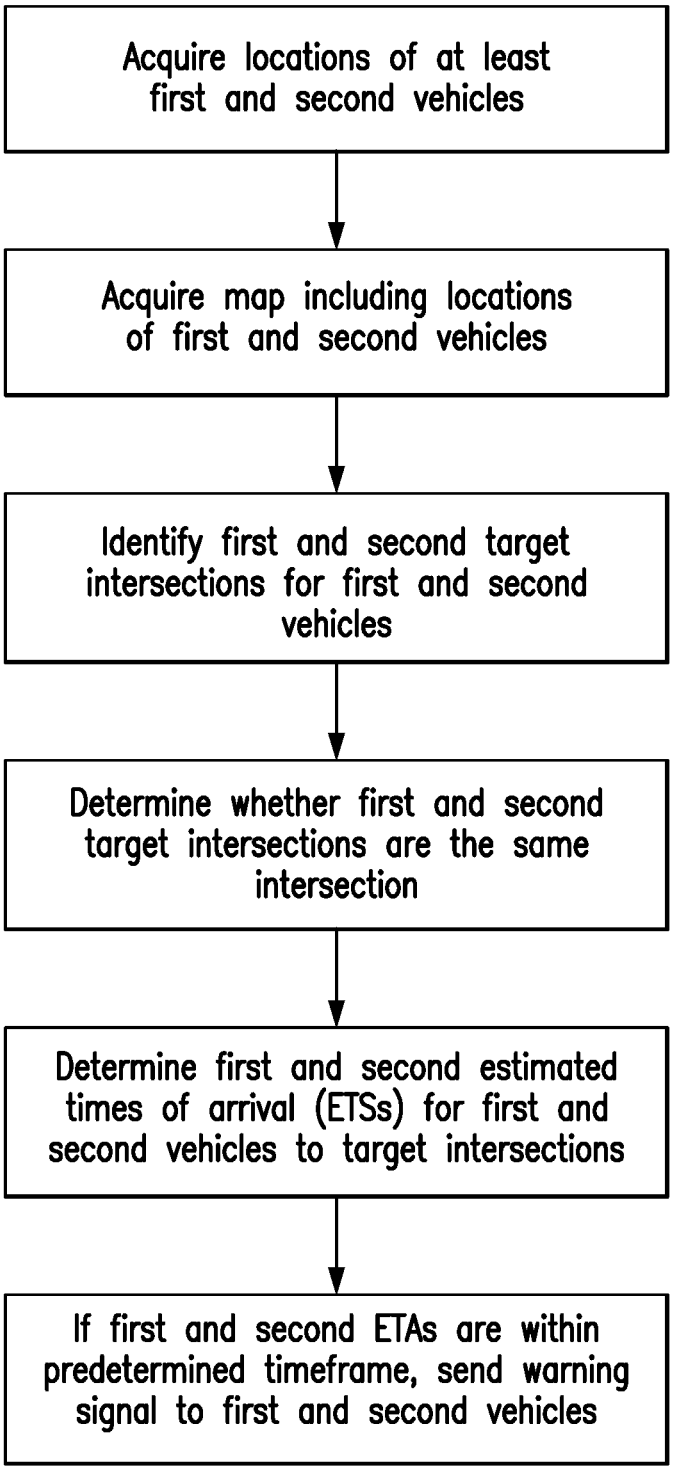
FIG. 4 is a flowchart illustrating another embodiment of a processes to determine if the vehicle is in the vicinity of an intersection and, if so, activating the warning device.

As indicated in FIG. 4, when a vehicle sends location data and timestamp to the server, the server can correlate the vehicle's location with other vehicles. Optionally, an enhanced graph-based intersection discovery system is used. This will allow the server to calculate estimated times of arrival for each vehicle at each upcoming intersection. When the ETA of two or more vehicles at a single intersection falls within a certain predetermined timeframe, an imminent collision warning may be delivered to each of the involved vehicles, allowing the vehicle operators to respond to prevent a collision. This warning may come in the form of a variety of audible, visual, or tactile feedback signals via output devices connected to the control assemblies in the vehicles.

In another embodiment, the control assembly may include a sensor for sensing a signal from a traffic control signal at an intersection which triggers the control assembly to initiate the intersection approach warning pattern.

In alternative embodiments, the collision warning signal may be implemented by a devices having another function, e.g., via a car sound system (radio) speaker.

Where this application has listed the steps of a method or procedure in a specific order, it may be possible, or even expedient in certain circumstances, to change the order in which some steps are performed, skip certain steps if quicker operation is programmed, and it is intended that the particular steps of the method or procedure claim set forth here below not be construed as being order-specific unless such order specificity is expressly stated in the claim.

While the preferred embodiments of the devices and methods have been described in reference to the environment in which they were developed, they are merely illustrative of the principles of the inventions. Modification or combinations of the above-described assemblies, other embodiments, configurations, and methods for carrying out the invention, and variations of aspects of the invention that are obvious to those of skill in the art are intended to be within the scope of the claims.

What is claimed is:

1. A process for the operation of a vehicle warning system for an emergency vehicle at a location, comprising:

acquiring a location signal from a GPS receiver on the emergency vehicle to identify the location of the emergency vehicle;

acquiring a map of the vicinity of the emergency vehicle;

providing a server to identify a target intersection on the map;

storing a proximity parameter on the server; and using the server to determine whether the emergency vehicle is within a predetermined proximity of the target intersection and if so, sending a signal from the server to the emergency vehicle to activate a warning device on the emergency vehicle to warn civilians of the approach of the emergency vehicle.

2. The process of claim 1 wherein the proximity parameter is a proximity distance and the process comprises determining a distance of the emergency vehicle from the target intersection and comparing the distance to the proximity parameter.

3. The process of claim 1 wherein the proximity parameter is a time-to-intersection arrival value and the process comprises determining an estimated time of arrival (ETA) of the emergency vehicle to the target intersection and comparing the ETA to the time-to-intersection arrival value.

4. The process of claim 3, further comprising:

determining a second estimated time of arrival for a second emergency vehicle to the target intersection; and issuing an imminent collision warning to the emergency vehicle and the second emergency vehicle when the estimated time of arrival falls within a predetermined timeframe relative to the second estimated time of arrival.

5. The process of claim 3, wherein the emergency vehicle is a first emergency vehicle and the estimated time of arrival is a first ETA, and further comprising:

acquiring a location signal from a GPS receiver on a second emergency vehicle to identify the location of the second emergency vehicle;

identifying a target intersection of the second emergency vehicle on the map;

determining a second ETA of the second emergency vehicle to its target intersection;

comparing the first ETA to the second ETA; and comparing the target intersection of the first emergency vehicle to the target intersection of the second emergency vehicle and, if the target intersection of the first emergency vehicle is the same as the target intersection of the second emergency vehicle and the first ETA and the second ETA are within a predetermined timeframe, issuing an imminent collision warning to the first emergency vehicle and to the second emergency vehicle.

6. The process of claim 5 wherein the imminent collision warning is audible, visual or tactile.

7. The process of claim 1 comprising acquiring the map in the form of a graph data file;

identifying a first target intersection vertex representing the target intersection; storing the proximity parameter;

creating a temporary emergency vehicle position vertex on an edge in the graph data file to represent the position of the emergency vehicle, generating a distance attribute relating the temporary emergency vehicle position vertex to the first target intersection vertex, and comparing the distance attribute to the proximity parameter to determine whether the emergency vehicle is in proximity of the target intersection.

* * * * *